US006966793B2

(12) United States Patent
Brekosky et al.

(10) Patent No.: US 6,966,793 B2
(45) Date of Patent: Nov. 22, 2005

(54) ELECTRICAL CONNECTOR HAVING A COVER FOR REGISTERING CABLES WITH CONTACTS

(75) Inventors: Lawrence John Brekosky, Dillsburg, PA (US); David James Fabian, Mount Joy, PA (US); Ricardo Lee Koller, Lititz, PA (US)

(73) Assignee: Tyco Electronics Corporation, Middletown, PA (US)

( * ) Notice: Subject to any disclaimer, the term of this patent is extended or adjusted under 35 U.S.C. 154(b) by 29 days.

(21) Appl. No.: 10/448,030

(22) Filed: May 22, 2003

(65) Prior Publication Data

US 2004/0235336 A1 Nov. 25, 2004

(51) Int. Cl.[7] ..... H01R 4/24

(52) U.S. Cl. ..... 439/417; 439/393; 439/425; 439/422

(58) Field of Search ..... 439/417, 404, 439/405, 403, 395, 393, 425, 426, 422

(56) References Cited

U.S. PATENT DOCUMENTS 4,089,580 A * 5/1978 Huffnagle et al. ..... 439/400
4,193,658 A 3/1980 Dittmann et al.
4,344,665 A * 8/1982 Racilla et al. ..... 439/407
4,522,460 A * 6/1985 Beck et al. ..... 439/404
4,697,862 A * 10/1987 Hasircoglu ..... 439/404
4,715,825 A 12/1987 Mouissie et al.
4,758,536 A * 7/1988 Miller et al. ..... 439/138
4,950,176 A 8/1990 Cocco et al.
5,417,581 A * 5/1995 Dechelette et al. ..... 439/393
6,332,801 B1 * 12/2001 Watanbe ..... 439/409
6,579,115 B2 * 6/2003 Mitsugi ..... 439/417

* cited by examiner

*Primary Examiner*—Ross Gushi

(57) ABSTRACT

An electrical connector is provided that includes a plurality of contacts having cable engaging ends that are configured to engage respective conductors in corresponding cables. The electrical connector includes a housing that holds the contacts parallel to one another and spaced apart at a predetermined pitch. A cover is mounted on the housing proximate the contacts and is movable between initial and final positions with respect to the housing. The cover has a cavity therein that is configured to receive and align the cables at the predetermined pitch with respect to one another. The cover includes a series of passages there through that align with the cable engaging ends of the contacts such that, when the cover is moved to the final position, the cable engaging ends of the contacts extend through the passages into the cavity to pierce the corresponding cables and engage corresponding conductors. Optionally, the cover may include a solid top wall without passages therethrough. The cavity may include ribs aligned with each cable.

17 Claims, 11 Drawing Sheets

ELECTRICAL CONNECTOR HAVING A COVER FOR REGISTERING CABLES WITH CONTACTS

BACKGROUND OF THE INVENTION

The present invention generally relates to an electrical connector, and more particularly to a cable connector with a cover that aligns and terminates cables onto corresponding individual contacts in the connector.

Electronic systems, such as computers, comprise a wide array of components that are interconnected to transfer signals and power throughout the system. Many such systems utilize groups of cables that have individual conductors separately surrounded by insulation. The insulated conductors may be joined with one another, such as in a ribbon cable, or maintained as individual insulated conductors. The cables transfer data signals and/or power between components of the system through connectors that are attached to opposite ends of one cable or groups of cables. Each connector includes at least one contact for each insulated conductor. During assembly, the cables are manually joined to corresponding contacts and connectors.

A wide variety of contacts have been proposed to facilitate joinder of the contacts with corresponding cables. One type of contact is an insulation displacement crimp (IDC) contact which generally includes a body formed with a transverse blade having a slot cut into the blade. An individual cable is positioned above the slot and pressed onto edges of the blade on both sides of the slot. The blade edges cut the insulation on the cable and the exposed conductor of the cable is inserted into the slot to form an electrical connection between the cable and the contact. The blade of the IDC contact is oriented perpendicular to the body of the contact and to the length of the cable. Thus, when multiple contacts are located next to one another within a connector, the connector's overall width becomes overly wide.

However, as connectors are made smaller, IDC contacts with thinner profiles are needed. In addition, the conductors are formed with smaller diameters. Consequently, it has become more difficult during manual assembly to align properly the conductors of each cable with the IDC contacts in order that the blades properly pierce the insulation when the cables are pressed onto the IDC contacts. Heretofore, the cables were manually aligned with the IDC contacts, such as with a tool resembling a comb that held a group of cables in a desired spacing. The user first loaded the cables into the comb-like tool. The cables were then located above the IDC contacts and the user pressed the cables into the IDC contacts. In addition, the individual cables may be separately attached to the contacts manually. However, these manual assembly processes were susceptible to alignment errors and were time consuming.

A need remains for an electrical connector that facilitates loading of multiple cables directly into a connector and that maintains proper alignment with corresponding contacts as the cables are pressed onto the contacts.

BRIEF DESCRIPTION OF THE INVENTION

An electrical connector is provided that includes a plurality of contacts having cable engaging ends that are configured to engage respective conductors in corresponding cables. The electrical connector includes a housing that holds the contacts parallel to one another and spaced apart at a predetermined spacing or pitch. A cover is held on the housing in alignment with the contacts and is movable between initial and final positions with respect to the housing (e.g., opened and closed). The cover includes an open-ended cavity that is configured to receive the cables. The cavity includes a contoured interior that aligns the cables at a predetermined pitch with respect to one another. The cover aligns the cables with cable engaging ends of the contacts such that, when the cover is moved to the final position, the cable engaging ends of the contacts extend into the cavity and engage corresponding conductors.

In at least certain embodiments, the cover includes a latch arm that engages a side wall of the housing to retain the cover separately in each of the initial and final positions and to guide the cover during movement with respect to the housing. The side wall of the housing includes first and second ramps that engage the latch member to hold the cover separately at the initial position and at the final position, respectively. Optionally, a pair of latch arms may be provided on opposite sides of the cover to engage opposite side walls of the housing.

The cover forces the cables onto the cable engaging ends of the contacts while retaining the cables in specific transverse positions and orientations with respect to the cable engaging ends of the contacts. Optionally, the contacts may be insulation displacement crimp (IDC) contacts. The IDC contacts may be configured with a plurality of blades oriented parallel to a longitudinal axis of the contact and offset laterally with respect to one another along opposite sides of the longitudinal axis of the corresponding IDC contact. The blades have a space there between. When the blades pierce the insulation of a corresponding cable, the conductor of the cable is received within the space between the blades and engages the blades to afford an electrical connection.

DETAILED DESCRIPTION OF THE INVENTION

Figure 1:
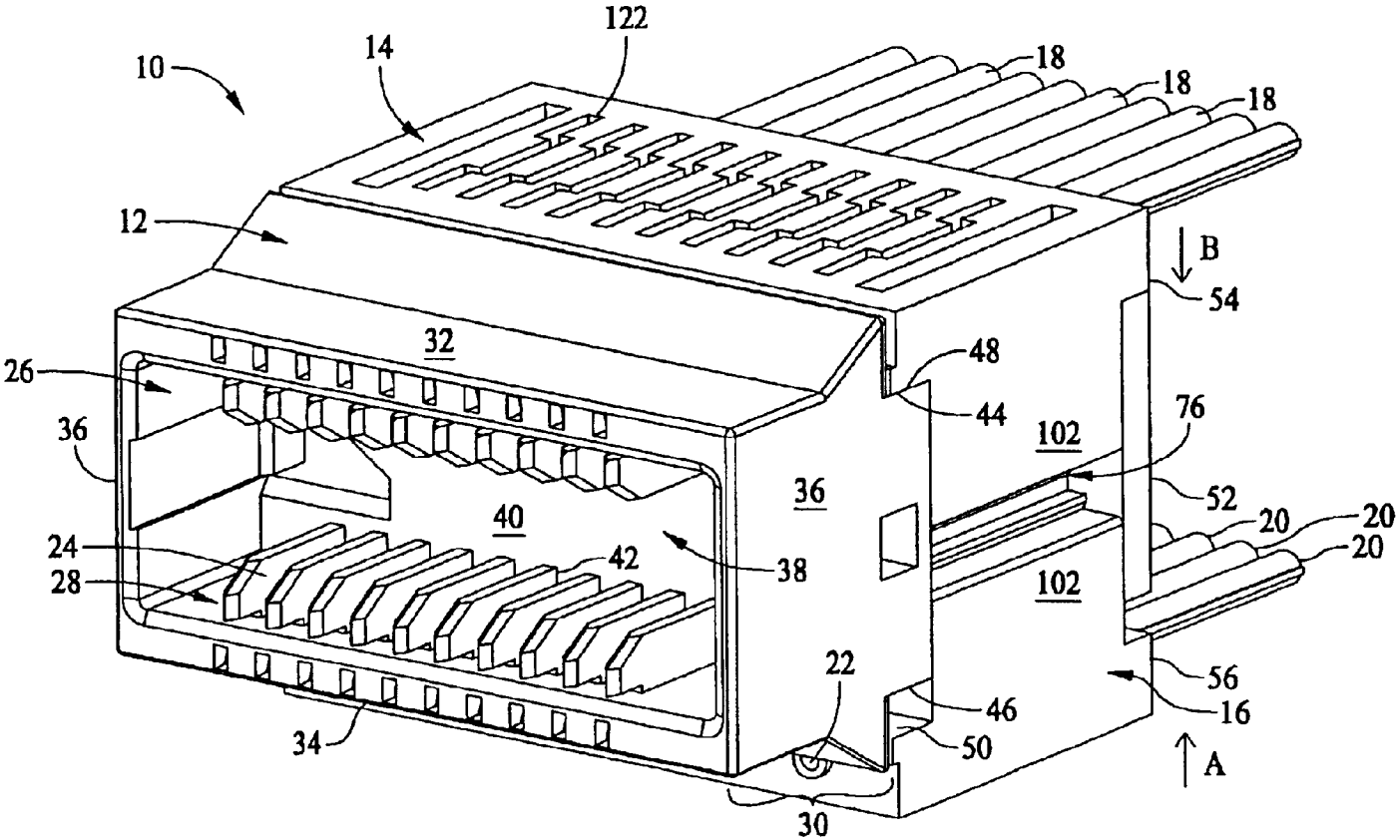
FIG. 1 illustrates a front isometric view of an electrical connector formed in accordance with an embodiment of the present invention with upper and lower covers provided in final and initial positions, respectively.

FIG. 1 illustrates an electrical connector 10 that includes a receptacle housing 12 that is joined with upper and lower covers 14 and 16. The upper and lower covers 14 and 16 receive cables 18 and 20, respectively. Each individual cable 18 and 20 includes a conductive core surrounded by insulation. Individual cables 18 and 20 may be formed separately or interjoined with insulation, such as in a ribbon cable. As shown in FIG. 1, the lower cover 16 is positioned in an initial position at which the cables 20 are easily loaded until forward ends 22 of the cables 20 extend through the lower cover 16. Once the cables 20 are fully loaded in the lower cover 16, the lower cover 16 may be moved in the direction of arrow A on the receptacle housing 12 from the initial position to a final position. The upper cover 14 is shown in the final position having already been moved in the direction of arrow B from the initial position.

The electrical connector 10 holds a plurality of contacts 24 in a predetermined orientation and spaced apart from one another by a predetermined spacing or pitch. In the example of FIG. 1, upper and lower sets 26 and 28 of contacts 24 are shown, although more or fewer contacts 24 may be used.

The receptacle housing 12 includes a plug interface 30 having top, bottom and side walls 32, 34 and 36, respectively, that collectively surround and define a plug cavity 38. The plug cavity 38 is configured to receive a plug connector (not shown) that mates with the receptacle housing 12. The plug interface 30 includes an interior wall 40 that includes slots 42 there through that permit leading ends of the contacts 24 to project into the plug cavity 38. The side walls 36 of the plug interface 30 include upper and lower shelves 44 and 46 that are positioned to engage corresponding cover front shelves 48 and 50 formed on the upper and lower covers 14 and 16, respectively. The upper and lower shelves 44 and 46 and the cover front shelves 48 and 50 abut against one another to limit the range of motion for the upper and lower covers 14 and 16, respectively. When the cover front shelves 48 and 50 abut the upper and lower shelves 44 and 46, the cables 18 and 20 and the upper and lower sets 26 and 28 of contacts 24, respectively, are fully mated.

Figure 2:
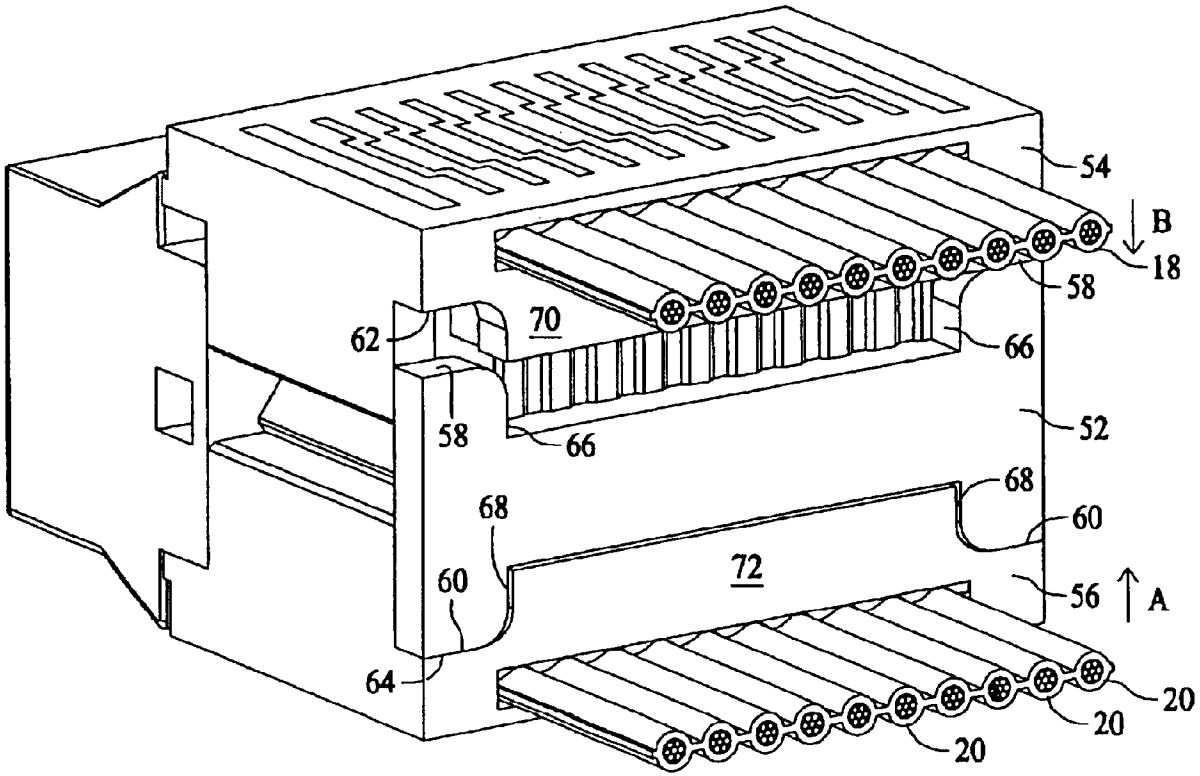
FIG. 2 illustrates a rear isometric view of the electrical connector of FIG. 1, but with the cover positions reversed such that the upper and lower covers are in the initial and final positions, respectively.

FIG. 2 illustrates a rear isometric view of the electrical connector 10 of FIG. 1, with the cover positions reversed from FIG. 1. The upper cover 14 is in the initial position and the lower cover 16 in the final position. FIG. 2 better illustrates a rear end 52 of the receptacle housing 12, and rear ends 54 and 56 of the upper and lower covers 14 and 16, respectively. The rear end 52 of the receptacle housing 12 includes upper and lower shelves 58 and 60 that engage cover rear shelves 62 and 64 to also limit the range of motion of the upper and lower covers 14 and 16, respectively, when moved to the final position. The rear end 52 of the receptacle housing 12 further includes interior notched surfaces 66 and 68 that receive guide bars 70 and 72 formed on the rear ends 54 and 56 of the upper and lower covers 14 and 16, respectively. The guide bars 70 and 72 fit between the interior notched surfaces 66 and 68 to guide the upper and lower covers 14 and 16 along a predetermined path when moved in the directions of arrows B and A, respectively, from the initial to final positions.

Figure 3:
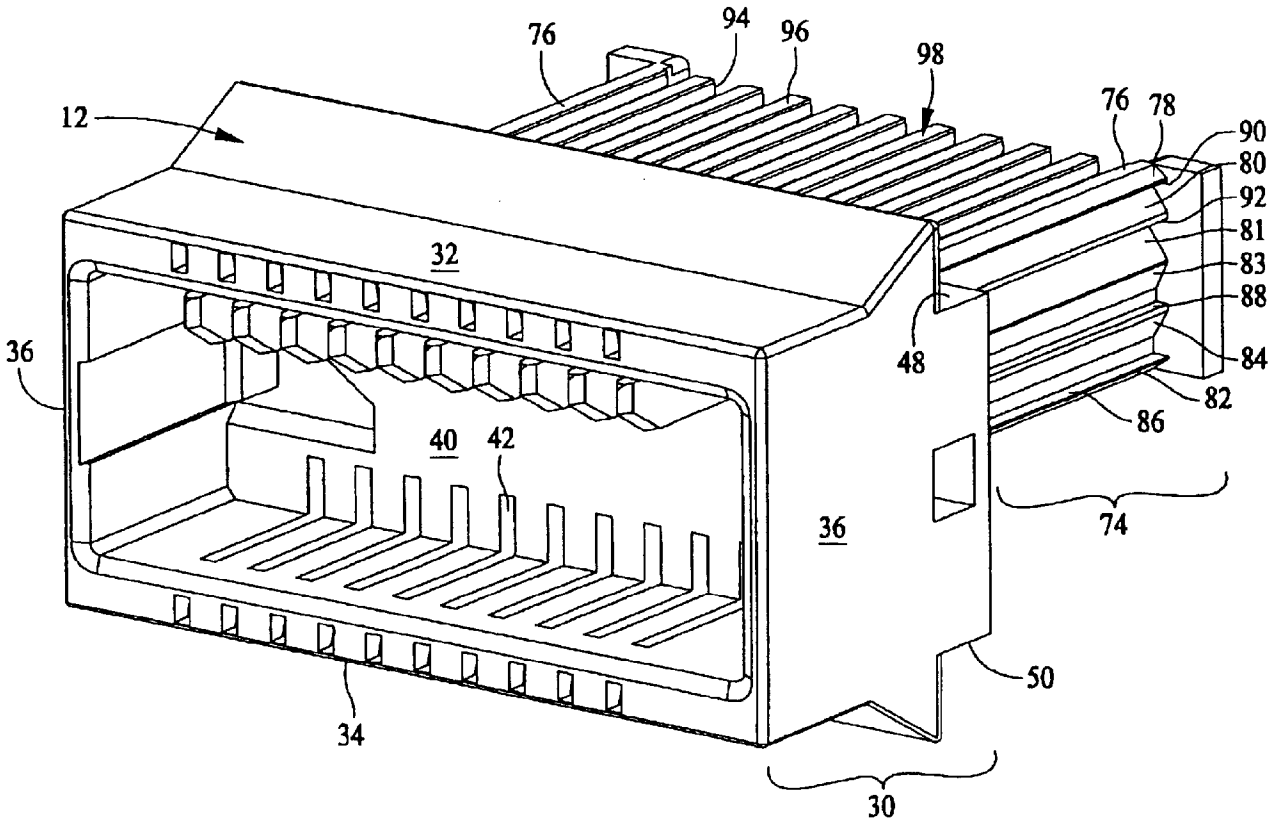
FIG. 3 illustrates an isometric view of the housing of the electrical connector of FIG. 1.

FIG. 3 illustrates the receptacle housing 12 with the contacts 24 and the upper and lower covers 14 and 16 removed. The receptacle housing 12 includes a contact/cover registration portion 74 that extends rearward from the plug interface 30. The contact/cover registration portion 74 retains the contacts 24 (FIG. 1) and upper and lower covers 14 and 16 (FIG. 1) in a predetermined alignment with one another throughout movement of the upper and lower covers 14 and 16 between the initial and final positions. The contact/cover registration portion 74 includes side walls 76 that have exterior surfaces facing outward away from one another. The exterior surfaces of the side walls 76 include upper ramps 78 and 80 and lower ramps 82 and 84. The lower ramps 82 and 84 include lower catch surfaces 86 and 88, respectively, that separately engage corresponding latch features on the lower cover 16 (explained below) to retain the lower cover 16 in each of the initial and final positions, respectively. The upper ramps 78 and 80 include upper catch surfaces 90 and 92, respectively, that separately retain the upper cover 14 in each of the initial and final positions, respectively.

The contact/cover registration portion 74 includes a series of channels 94 that are separated by partition walls 96. Each channel 94 has an open upper surface along the top 98 of the contact/cover registration portion 74. The channels 94 receive contacts 24 (as better shown in FIG. 6) and separate the contacts 24 by a predetermined spacing or pitch.

Figure 4:
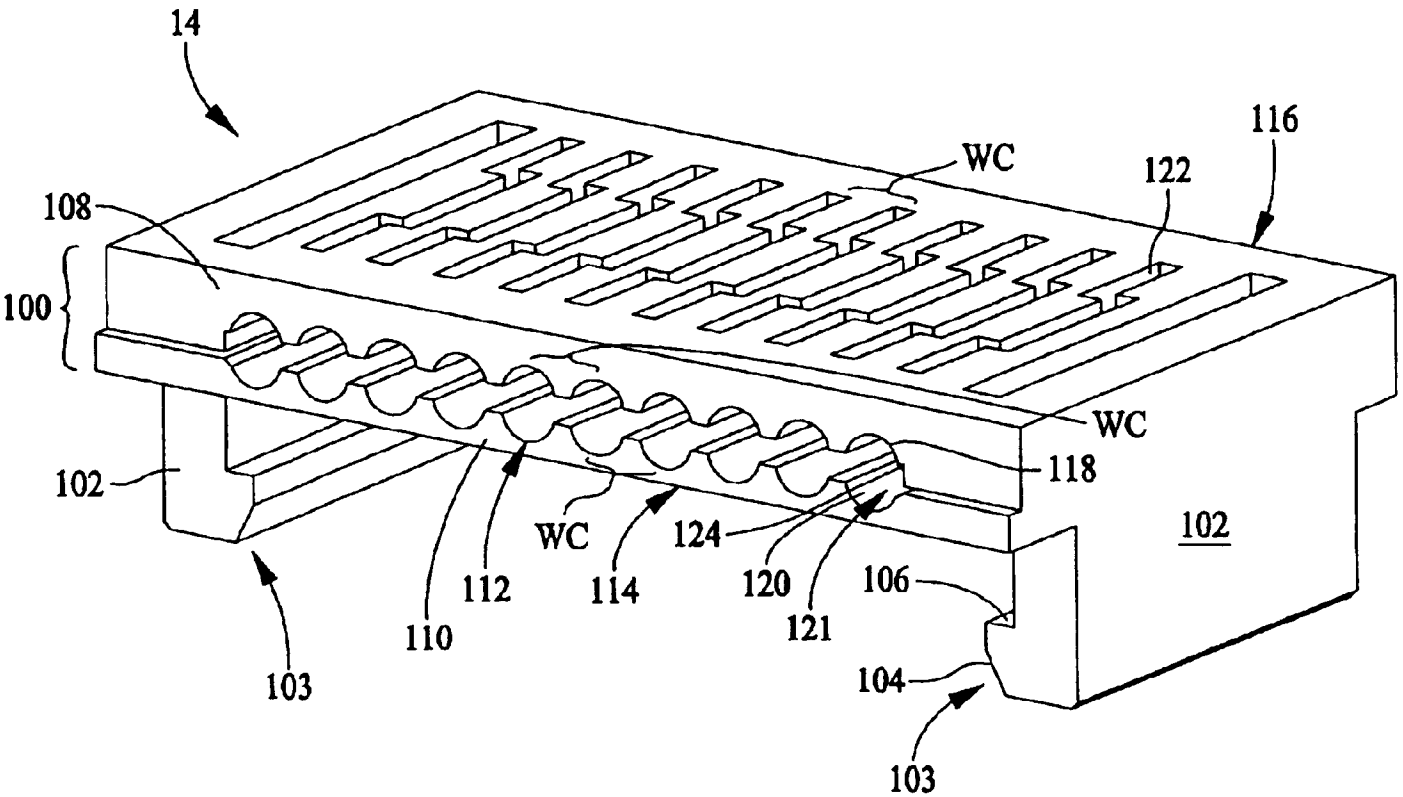
FIG. 4 illustrates an isometric view of the cover of the electrical connector of FIG. 1.

FIG. 4 illustrates the upper cover 14 in more detail. It is understood that the upper and lower covers 14 and 16 may be identical. The upper cover 14 includes a cable retention portion 100 that is joined with latch arms 102 extending downward therefrom along opposite sides of the upper cover 14. The latch arms 102 include latch elements 103 that are formed at the lower end of each latch arm 102 and oriented to face one another. The latch elements 103 include sloped surfaces 104 and latch surfaces 106. The cover 14 is initially inserted onto the receptacle housing 12 by pressing the latch arms 102 downward over the side walls 76 until the sloped surfaces 104 ride over the upper ramps 78 (FIG. 3). Once the sloped surfaces 104 pass the ramps 78, the latch surfaces 106 engage the upper catch surfaces 90 to prevent the upper cover 14 from being removed. The sloped surfaces 104 rest on the upper ramps 80 to prevent the upper cover 14 from freely moving to the final position. The latch arms 102 hold the upper cover 14 in an initial position (e.g., open), at which the cables 18 (FIG. 2) may be loaded into the upper cover 14. When it is desirable to move the upper cover 14 to the final position (e.g., closed), sloped surfaces 104 are pressed downward past the upper ramps 80 until the latch surfaces 106 on the latch elements 103 engage the upper catch surfaces 92 and the sloped surfaces 104 rest against the final stop surface 81.

The lower cover 16 (FIGS. 1 and 2) is similarly assembled and moved between the initial and final positions through engagement with the lower ramps 82 and 84 and a final stop surface 83.

The cable retention portion 100 includes top and bottom walls 108 and 110 that are separated by a cavity 112. The cavity 112 may extend through the front and rear faces 114 and 116 of the upper cover 14 to permit visual inspection and confirmation that cables are fully inserted. Alternatively, the rear face 116 may be solid with the cavity 112 having a closed rear end. The interior of the cavity 112 is contoured with arced surfaces 118 and 120 that align to define tubular holes 121 that are configured to receive individual insulated cables. The spacing between, and radius of, the arced surfaces 118 and 120 are determined by the outer diameter of the insulation upon the individual cables 18. A relatively close tolerance may be provided between the arced surfaces 118 and 120 and the outer diameter of the insulated cables 18 in order that each individual cable, once inserted into the upper cover 14 is is not permitted to shift or twist laterally within the cavity 112.

The top and bottom walls 108 and 110 include passages 122 and 124 there through, respectively. The passages 122 and 124 are aligned with one another along a vertical plane extending through the central axis of the corresponding hole 121 defined by a respective pair of arced surfaces 118 and 120. A number of passages 122 and 124 are provided in the top and bottom walls 108 and 110 equal to the number of cables 18 intended to be held by cavity 112. The passages 122 and 124 are dimensioned and shaped to receive a cable engaging portion 128 of corresponding contacts 24 (FIG. 5) as explained below in more detail.

Figure 5:
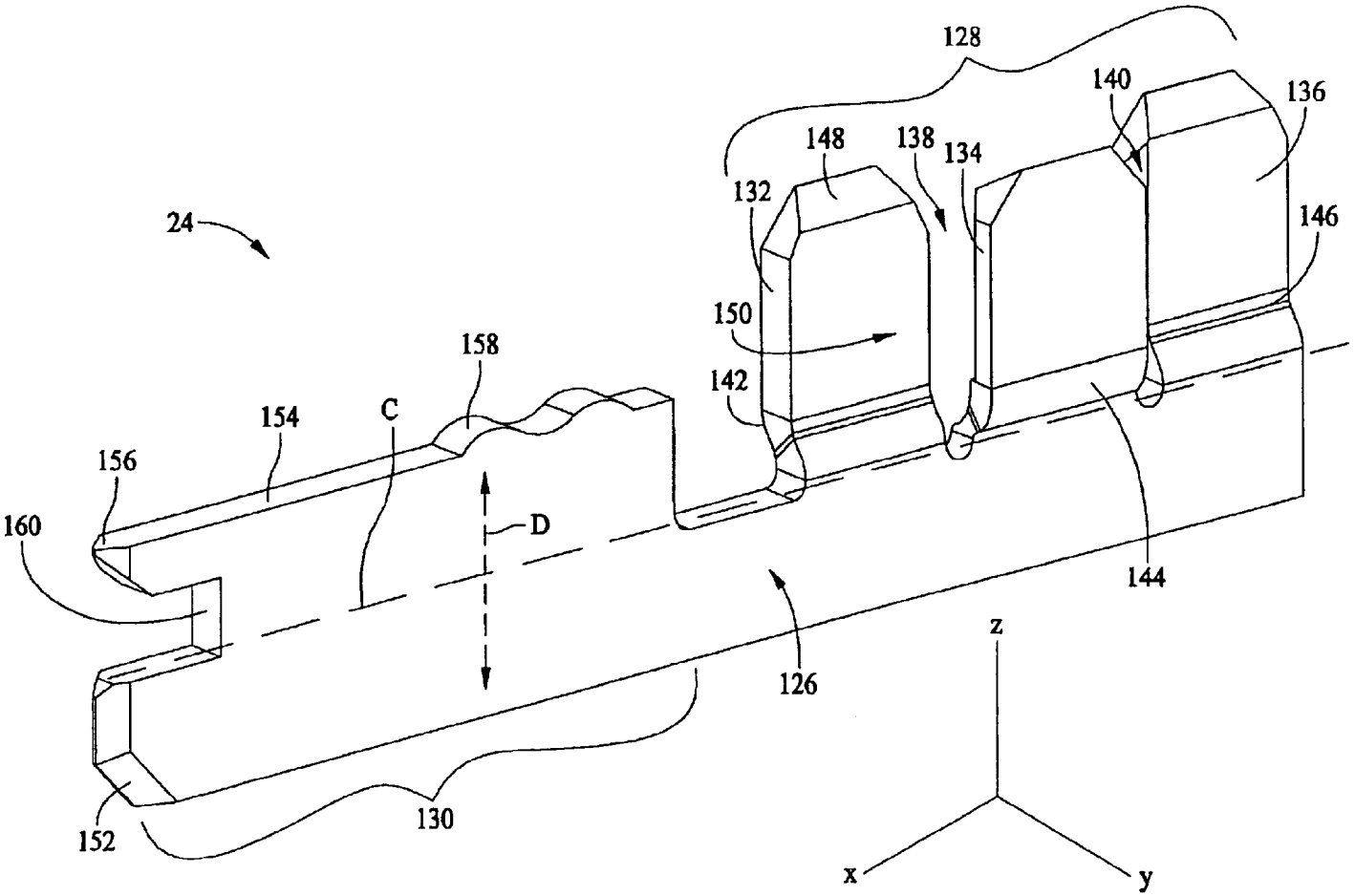
FIG. 5 illustrates an isometric view of an IDC contact used in accordance with an embodiment of the present invention.

FIG. 5 illustrates an isometric view of a contact 24 which includes a main body 126 having a cable-engaging portion 128 formed integrally with a plug-engaging portion 130. The cable-engaging portion 128 is formed in a multi-blade configuration having front, middle and rear blades 132, 134 and 136. The front blade 132 is separated from the middle blade 134 by a space 138 while the middle blade 134 is separated from the rear blade 136 by a space 140. The front, middle and rear blades 132, 134 and 136 extend upwardly from the main body 126 through curved transition portions 142, 144 and 146 that are integrally connected with the main body 126. The main body 126 is formed within a contact plane containing longitudinal and transverse axes C and D. The curved transition portions 142, 144 and 146 are formed so that the front and rear blades 132 and 136 are offset to a common side of the contact plane. The middle blade 134 is offset to an opposite side of the contact plane. The front, middle and rear blades 132, 134 and 136 are positioned end-to-end with one another along the longitudinal axis C of the contact 24. The front, middle and rear blades 132, 134 and 136 are arranged in an alternating fashion over a portion of the longitudinal axis C. The front, middle and rear blades 132, 134 and 136 have chamfered tips 148.

A cable retention area 150 is defined between the interior surfaces of the front, middle and rear blades 132, 134 and 136. The cable retention area 150 is dimensioned to receive a conductor, or wire bundle to form an electrical connection with the front, middle and rear blades 132, 134 and 136.

Optionally, more or fewer blades may be formed on the contact 24. As shown in FIG. 2, the plug-engaging portion 130 extends along the longitudinal axis C. The plug-engaging portion 130 includes a contact element 152 formed with a housing locating member 154. The contact element 152 is configured to mate with a corresponding contact element of a plug housing. The housing locating member 154 is configured to be slidably, snapably, or otherwise securably retained by a corresponding channel within the receptacle housing 12. Optionally, the housing locating member 154 includes a guide tip 156 and locating features 158. The guide tip 156 and the locating features 158 are configured to engage corresponding structures within the receptacle housing 12. A notch 160 is formed between the guide tip 156 and the contact element 152. The guide tip 156 may be removed entirely.

Figure 6:
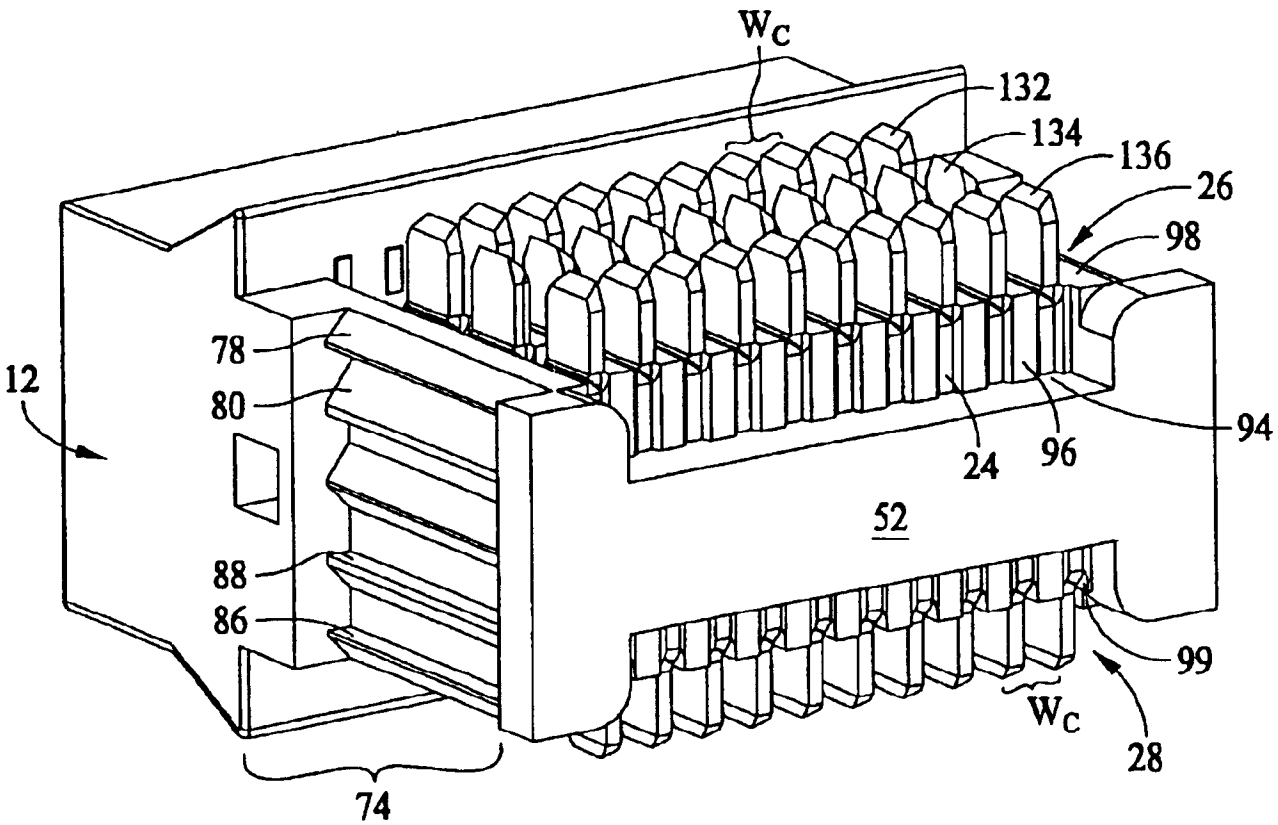
FIG. 6 illustrates a rear isometric view of the housing for the electrical connector of FIG. 1 with a plurality of IDC contacts loaded therein in accordance with an embodiment of the present invention.

FIG. 6 illustrates a rear isometric view of the receptacle housing 12 with the upper and lower sets 26 and 28 of contacts 24 inserted and extending from the contact/cover registration portion 74. As shown in FIG. 6, the contacts 24 are firmly held within individual channels 94 and are separated by the partition walls 96. The top, middle and rear blades 132, 134 and 136 project beyond the top 98 and bottom 99 of the contact/cover registration portion 74. The front, middle and rear blades 132, 134 and 136 of each individual contact 24 are separated from corresponding front, middle and rear blades 132, 134 and 136 of the neighboring contacts 24 by a predetermined spacing or pitch $W_C$.

Returning to FIG. 4, adjacent passages 122, adjacent arced surfaces 118 and adjacent arced surfaces 120 are all spaced apart by the same pitch $W_C$. By maintaining the desired pitch $W_C$, the cavity 112 maintains adjacent cables 18 (FIG. 1) at the desired pitch $W_C$ with respect to one another and in align with the passages 124 and 122 which in turn align the front, middle and rear blades 132, 134 and 136 of corresponding contacts 24 with cables 18.

Figure 7:
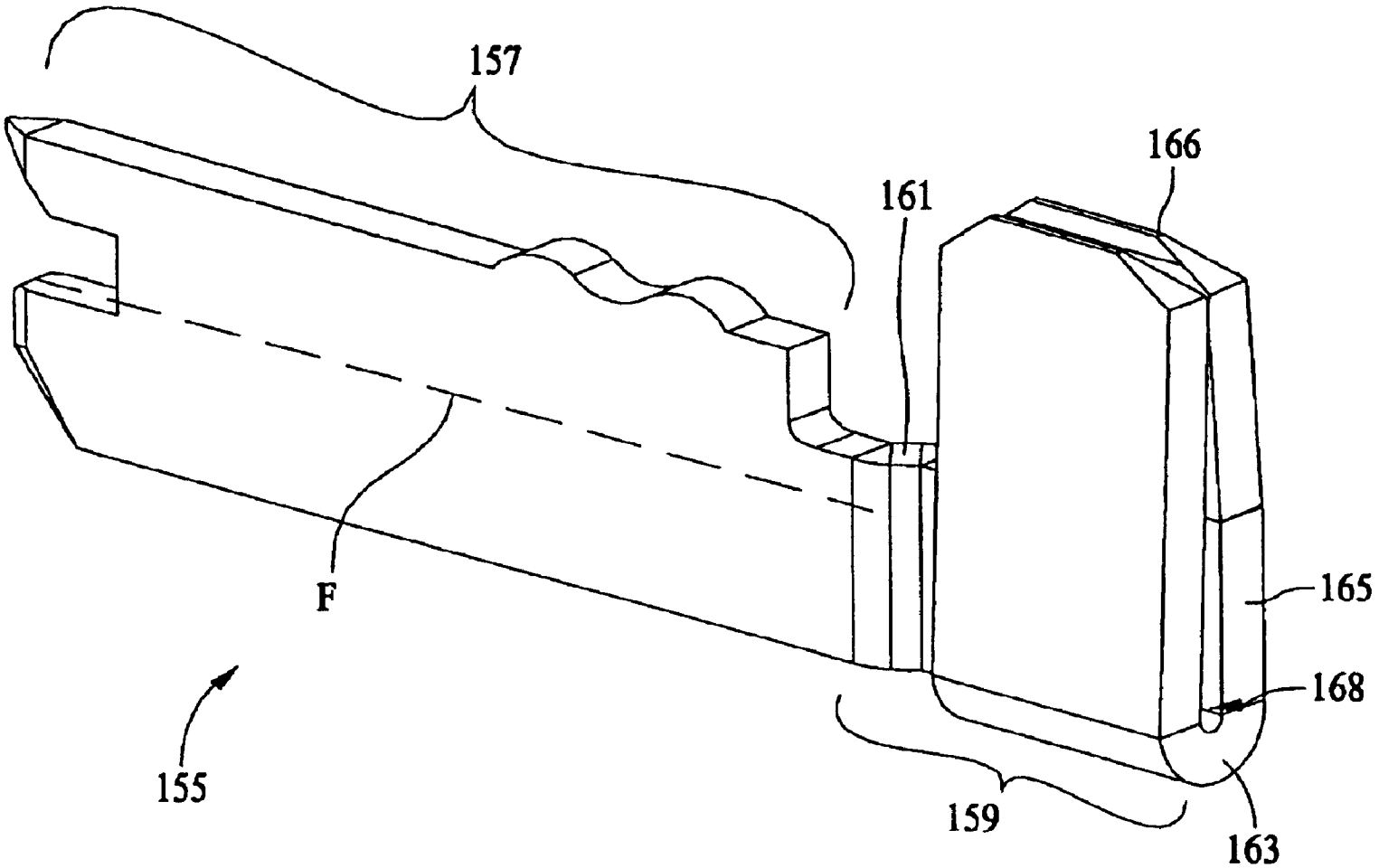
FIG. 7 illustrates an IDC contact used in accordance with an alternative embodiment of the present invention.

FIG. 7 illustrates an isometric view of a contact 155 formed according to an alternative embodiment of the present invention. The contact 155 includes a plug-engaging portion 157 integrally formed with a wire-engaging portion 159 through a bent transition portion 161 that is outwardly bowed from the plane of the plug-engaging portion 157. The wire-engaging portion 159 includes a U-shaped wire retainer that includes a curved base 163 integrally formed with two canted upright beams 165. Each beam 165 includes a chamfered tip 166 that is configured to pierce and penetrate insulation on a cable. The upright beams 165 are laterally aligned with one another and are oriented parallel to the longitudinal axis F and parallel to one another. A cable retention area 168 is defined between the upright beams 165 and the curved base 163. The upright beams 165 are configured to contact and compressively sandwich a conductor or wire bundle of a cable disposed within the cable retention area 168. As shown in FIG. 7, the bent transition portion 161 is integrally formed with one of the upright beams 165 such that the center of the cable retention area 168 is aligned with the longitudinal axis F of the contact 155.

Figure 8:
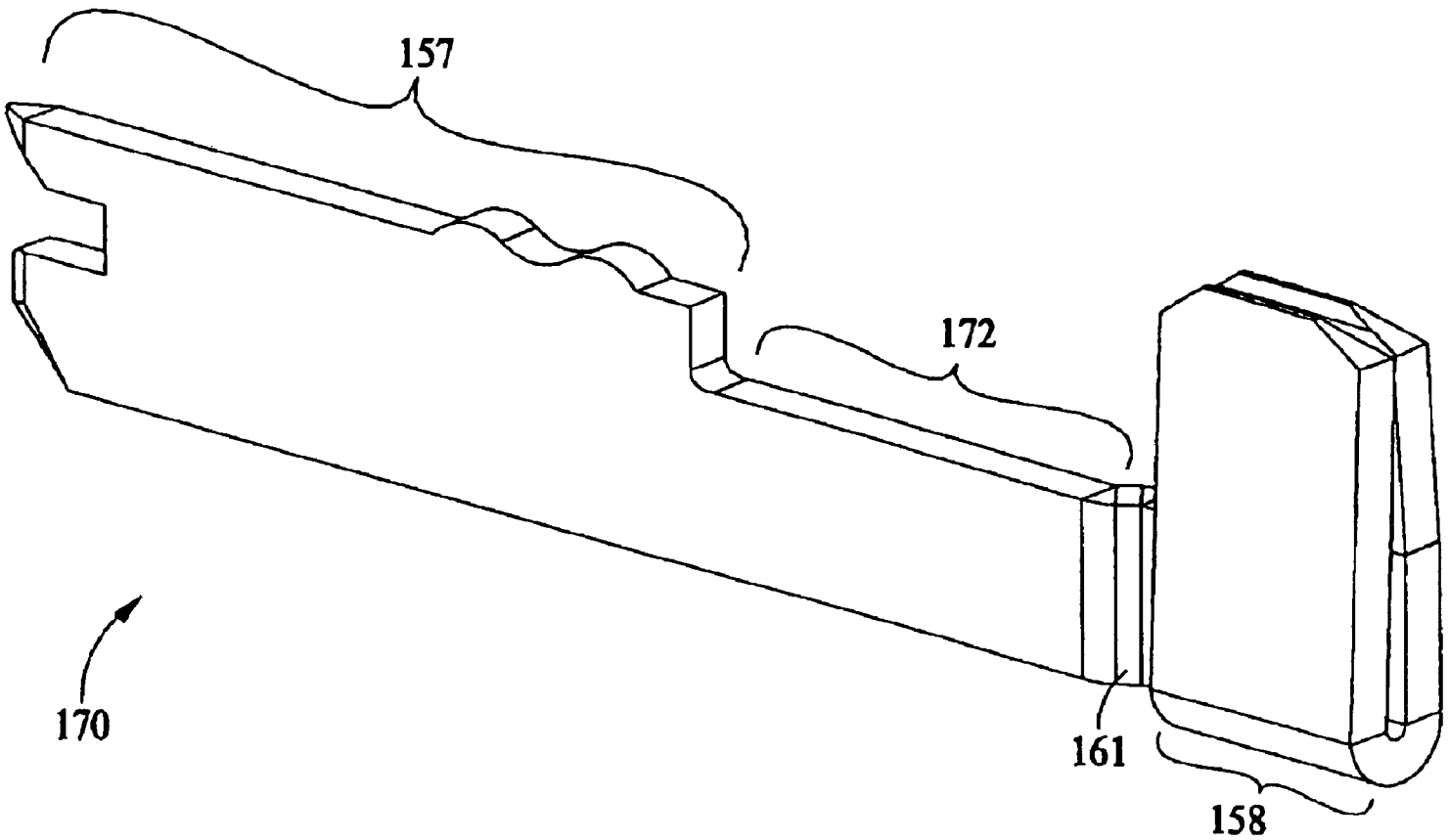
FIG. 8 illustrates an IDC contact used in accordance with an alternative embodiment of the present invention.

FIG. 8 illustrates an isometric view of a contact 170 formed according to an alternative embodiment of the present invention. The contact 170 is similar to the contact 155 except that the plug-engaging portion 157 integrally connects to the bent transition portion 161 through an extended portion 172. The contact 170 is longer than the contact 155.

Figure 9:
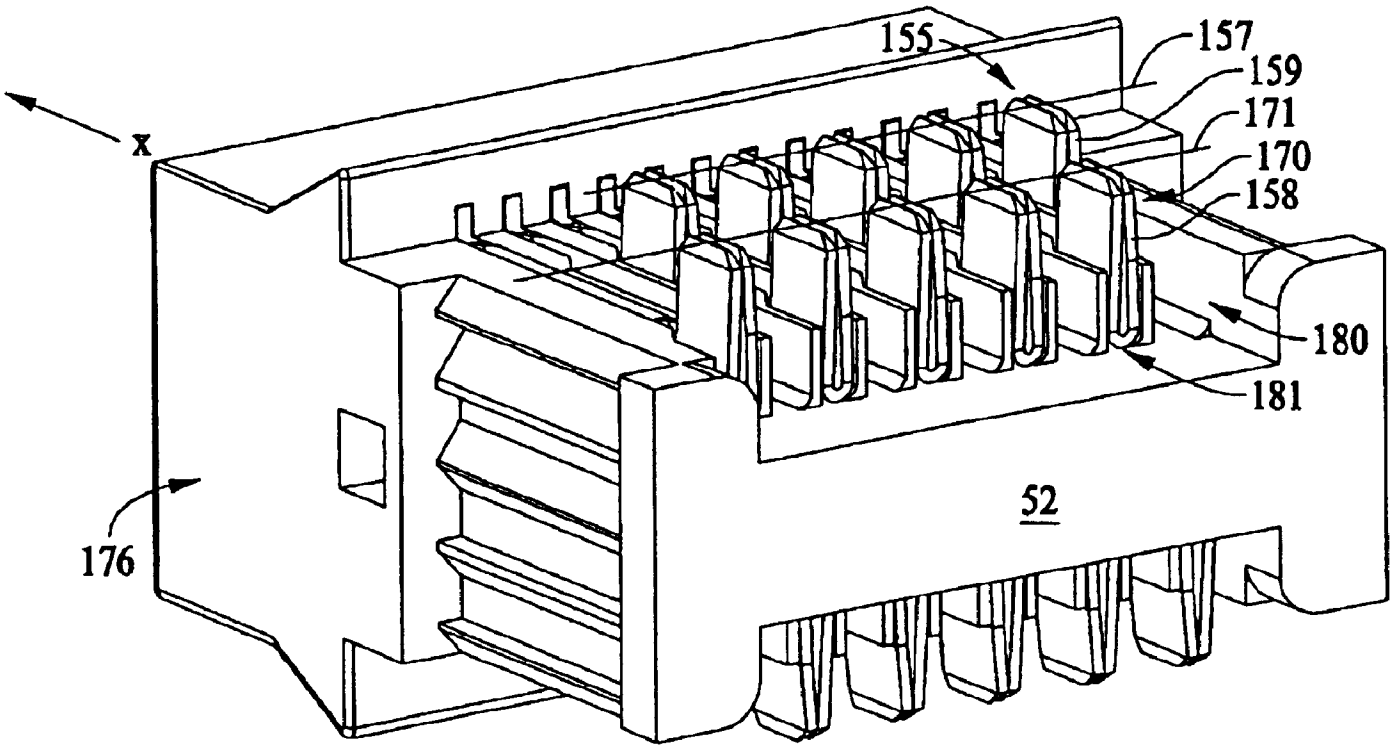
FIG. 9 illustrates a housing loaded with the IDC contacts of FIGS. 7 and 8 for an electrical connector formed in accordance with an alternative embodiment of the present invention.

FIG. 9 illustrates an isometric view of a receptacle housing 174 according to an alternative embodiment of the present invention. The receptacle housing 174 is similar to the receptacle housing 12 shown in FIG. 6 except that adjacent contacts 155 and 170 are retained within the receptacle housing 174 in a staggered orientation with respect to one another due to the difference in lengths between the contacts 155 and 170. The contacts 155 are positioned in alternate channels 180 with wire-engaging portions 159 aligned along a transverse axis 157. The contacts 170 are positioned in alternate channels 181 with wire-engaging portions 158 aligned along a transverse axis 171. The transverse axes 157 and 171 are parallel and staggered with respect to one another.

Figure 10:
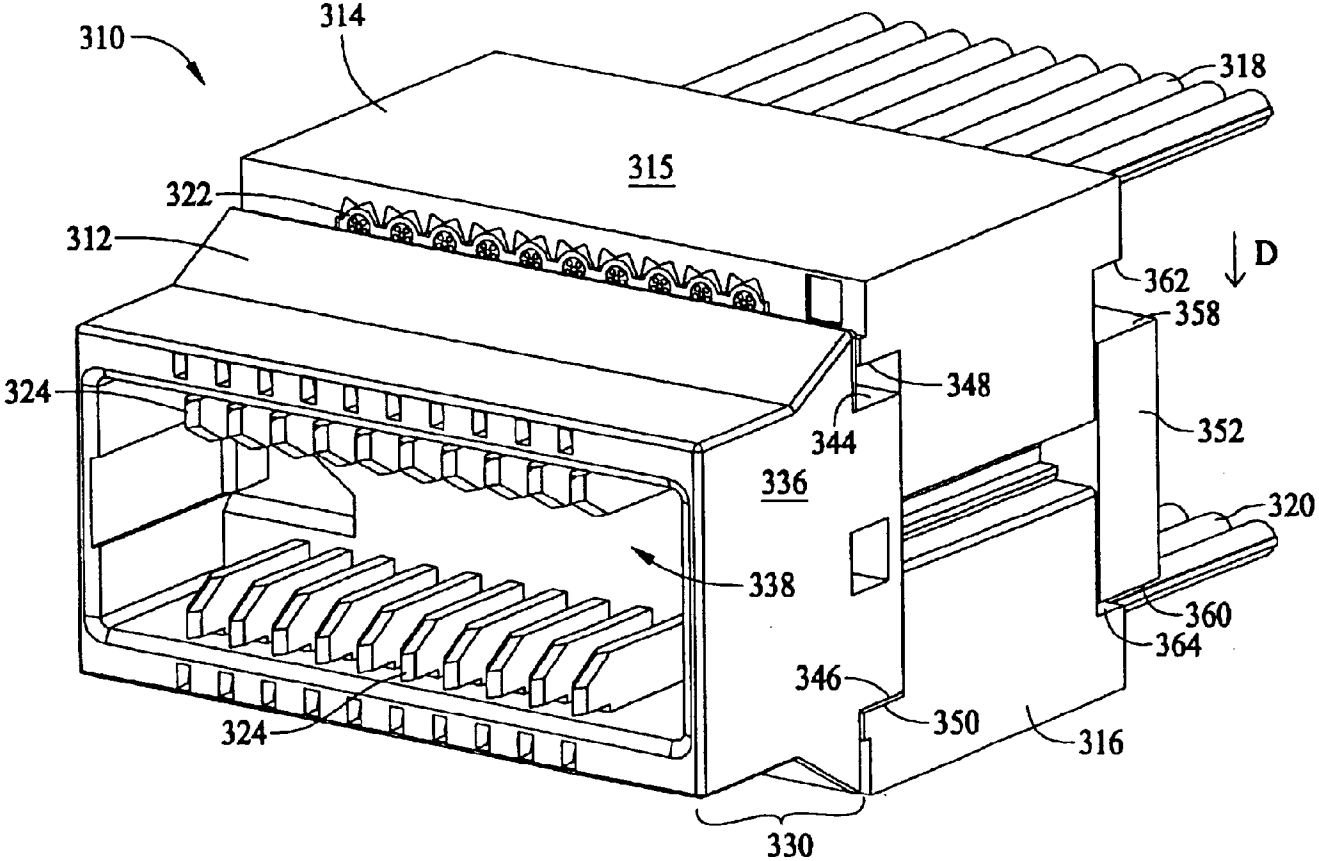
FIG. 10 illustrates a front isometric view of an electrical connector formed in accordance with an alternative embodiment of the present invention with the upper and lower covers provided in initial and final positions, respectively.

FIG. 10 illustrates an electrical connector 310 that includes a receptacle housing 312 that is joined with upper and lower covers 314 and 316, respectively. The upper and lower covers 314 and 316 receive cables 318 and 320, respectively. As shown in FIG. 10, the upper cover 314 is positioned in an initial position at which the cables 318 are easily loaded until forward ends 322 of the cables 318 extend through the upper cover 314. Once the cables 318 are fully loaded in the upper cover 314, the upper cover 314 may be moved in the direction of arrow D from the initial position.

The receptacle housing 312 includes a plug interface 330 that contains a plug cavity 338. Contacts 324 project into the plug cavity 338. Side walls 336 of the plug interface 330 include upper and lower shelves 344 and 346 that are positioned to engage corresponding cover front shelves 348 and 350 formed on the upper and lower covers 314 and 316, respectively. A rear end 352 of the receptacle housing 312 includes upper and lower shelves 358 and 360 that engage cover rear shelves 362 and 364 to also limit the range of motion of the upper and lower covers 314 and 316, respectively. In the embodiment of FIG. 10, the upper cover 314 includes a top surface 315 that is continuous and solid without passages therethrough (such as passages 122 through the top wall 108 of the upper cover 314 shown in FIG. 1).

Figure 11:
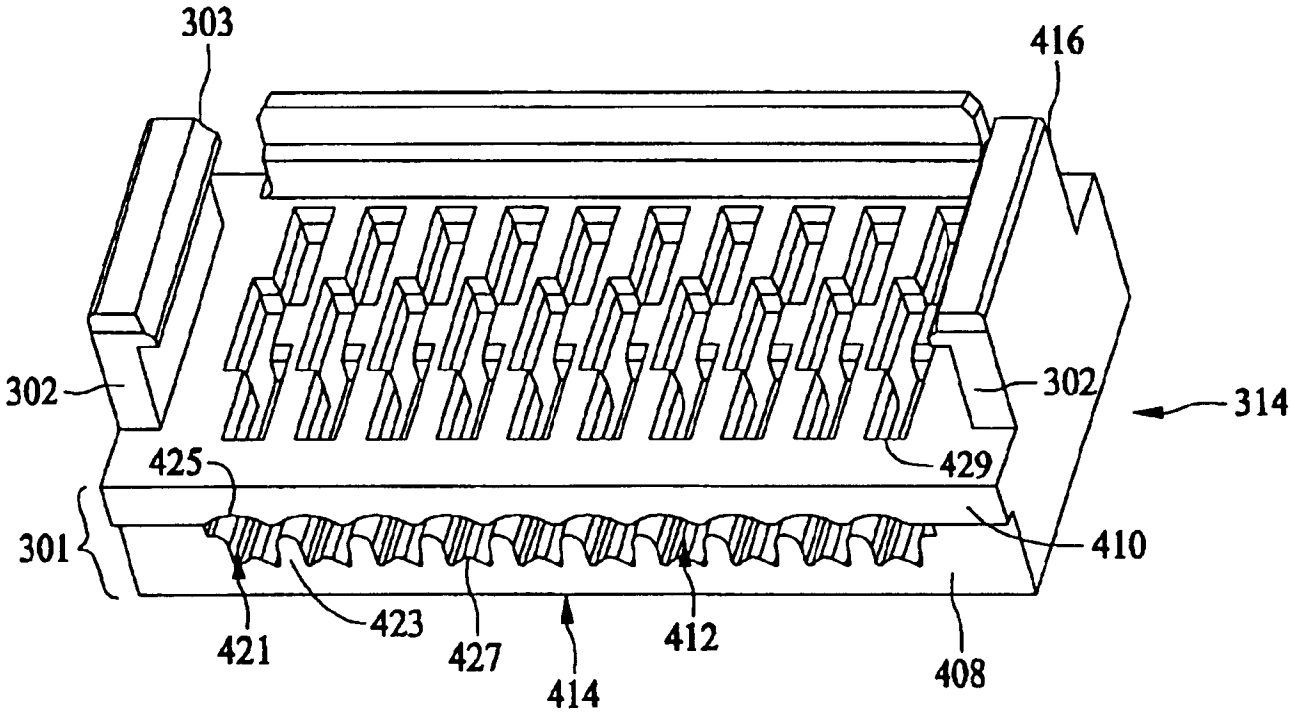
FIG. 11 illustrates a bottom isometric view of a cover formed in accordance with an alternative embodiment of the present invention.

FIG. 11 illustrates a bottom isometric view of the upper cover 314 in more detail. Again, it is understood that the upper and lower covers 314 and 316 may be identical. The upper cover 314 includes a cable retention portion 301 that is joined with latch arms 302 extending outward therefrom along opposite sides of the upper cover 314. The latch arms 302 include latch elements 303 that are formed at the lower end of each latch arm 302 and oriented to face one another. The latch arms 102 engage the receptacle housing 312 in a manner similar to that explained above in connection with the embodiment of FIG. 1 and thus a detailed description thereof is not repeated here.

The cable retention portion 301 includes top and bottom walls 408 and 410 that are separated by a cavity 412. The cavity 412 may extend through front and rear faces 414 and 416 of the upper cover 314. Alternatively, the rear face 416 may be solid with the cavity 412 having a closed rear-end. The interior of the cavity 412 is contoured in a manner slightly different from the contour formed with the cavity 112 of the embodiment of FIG. 1.

The cavity 412 is separated into a series of channels 421 by intervening bridges 423 that project into the cavity 412 from the top wall 408. An opposed side of each channel 421 is aligned with a recessed arc 425 formed in the mating surface of the bottom wall 410. The bridges 423 extend between the front and rear faces 414 and 416. Within each channel 421, a rib is formed in the top wall 408 and shaped to project into the corresponding channel 421. The ribs 427 also extend between the front and rear faces 414 and 416. The ribs 427 are aligned with the recessed arcs 425 which in turn join passages 429 that are cut through the bottom wall 410. The passages 429 resemble passages 124 formed in the bottom wall 110 of the embodiment of FIG. 4. The passages 429 are shaped to receive corresponding portions of the contacts 324. The bridges 423 and ribs 427 cooperate to properly align each cable 318 (FIG. 10) within the channel 421 relative to the corresponding passage 429. The ribs 427 press upon corresponding cables 318 to drive each cable 318 onto the wire engaging portion of the corresponding contact 324 (FIG. 10). The contacts 324 may be formed similar to the contacts 24 discussed above.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed:

1. An electrical connector, comprising:

a contact extending along a longitudinal axis, said contact having at least one blade oriented parallel to said longitudinal axis, said blade being configured to engage a conductor of a cable when the conductor is aligned parallel to said blade;

a housing holding said contact; and a cover having a face and a wall adjacent to one another, said cover being held on said housing proximate said contact, said cover having a cavity that is configured to receive the cable through said face along a first direction parallel to said blade and to said longitudinal axis, said cover being movable with respect to said housing between initial and final positions along a second direction transverse to said longitudinal axis, wherein said cover includes a latch arm that engages a wall of said housing to retain said cover separately in each of said initial and final positions, said blade projecting along said second direction through said wall into said cavity to engage the conductor in the cable along a length of the conductor when said cover is moved to said final position along said second direction transverse to said longitudinal axis.

2. The electrical connector of claim 1, wherein said cavity in said cover includes contoured interior surfaces configured to receive and align a plurality of cables at a predetermined pitch and orientation with respect to one another.

3. The electrical connector of claim 1, wherein said wall has a passage therethrough that joins said cavity, said passage aligned with said blade of the said contact, such that said blade extends through said passage into said cavity when said cover is in said final position.

4. The electrical connector of claim 1, wherein said latch arm separately engages first and second ramps on a wall of said housing, said first and second ramps holding said cover in said initial and final positions, respectively.

5. The electrical connector of claim 1, wherein said cavity is configured to receive and align the cable, once loaded, parallel to said blade and said longitudinal axis when said cover is in said initial position, said blade being held outside of said cavity when said cover is in said initial position and when the cable is in said cavity.

6. The electrical connector of claim 1, wherein said cavity is configured to align the cable, once loaded, with said blade as said cover forces the cable onto said blade.

7. The electrical connector of claim 1, wherein said contact includes at least two blades separated by a space, said blades being configured to pierce insulation on opposite sides of a conductor of the cable such that the conductor fits into said space.

8. The electrical connector of claim 1, further comprising a plurality of contacts spaced apart from one another in said housing by a predetermined pitch, said cavity including holes configured to space apart respective cables from one another by said pitch.

9. The electrical connector of claim 1, wherein said housing has a channel that receives said contact, said channel having an opening onto an exterior wall of said housing to expose said blade, said opening being directed in said second direction transverse to said longitudinal axis and aligning with a passage through said cover into said cavity.

10. An electrical connector, comprising:

a contact extending along a longitudinal axis, said contact having a blade oriented parallel to said longitudinal axis;

a housing holding said contact; and a cover positioned on said housing in alignment with said blade of said contact, said cover having a cavity that is configured to receive and orient an insulated cable parallel to and in alignment with said longitudinal axis and said blade, said cover being movable to a final position on said housing in a direction transverse to said longitudinal axis of said contact with said blade extending into said cavity, wherein said cover includes a pair of latch arms on opposite sides thereof configured to engage opposite sides of said housing, said latch arms holding said cover with respect to said housing at said initial and final positions.

11. The electrical connector of claim 10, wherein said contact includes a plurality of said blades offset laterally on opposite sides of said longitudinal axis and engaging the insulated cable along a length of the insulated cable.

12. The electrical connector of claim 10, wherein said contact includes a plurality of said blades staggered with respect to one another along said longitudinal axis, said blades being configured to pierce insulation of a cable at different points along a length of the cable.

13. The electrical connector of claim 10, wherein said housing includes a channel that opens onto an exterior wall of said housing in a direction transverse to said longitudinal axis, said channel receiving said contact with said blade extending upward from said exterior wall.

14. The electrical connector of claim 10, further comprising a plurality of contacts, and wherein said housing includes a plurality of channels that are separated by partitioned walls, said channels holding individual contacts separated by a pitch, said cavity in said cover being configured to individually space apart an equal plurality of cables by said pitch.

15. The electrical connector of claim 10, wherein said cover includes a passage through said wall that joins said cavity, said passage being oriented parallel to said longitudinal axis and aligning with said blade of said contact, said blade of said contact passing through said passage in a direction transverse to said longitudinal axis as said cover is moved to said final position.

16. The electrical connector of claim 10, wherein said cover includes top and bottom walls having contoured interior surfaced to define, within said cavity, individual areas configured to receive individual cables, said bottom wall including a plurality of passages oriented parallel to said longitudinal axis and aligned to receive respective blades on a plurality of said contacts held in said housing.

17. The electrical connector of claim 10, wherein said cover includes a face adjacent to said wall, said cavity extending through said face to receive the cable through said face along a direction parallel to said longitudinal axis, said wall having a passage therethrough receiving said blade along a direction transverse to said longitudinal axis.

* * * * *